US011745984B2

(12) United States Patent
Koketsu

(10) Patent No.: US 11,745,984 B2
(45) Date of Patent: Sep. 5, 2023

(54) DOOR-PINCH DETECTION DEVICE AND ELEVATOR DOOR DEVICE

(71) Applicant: Mitsubishi Electric Corporation, Tokyo (JP)

(72) Inventor: Masahiko Koketsu, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 250 days.

(21) Appl. No.: 17/252,745

(22) PCT Filed: Oct. 23, 2018

(86) PCT No.: PCT/JP2018/039310

§ 371 (c)(1),
(2) Date: Dec. 16, 2020

(87) PCT Pub. No.: WO2020/084679

PCT Pub. Date: Apr. 30, 2020

(65) Prior Publication Data

US 2021/0179390 A1 Jun. 17, 2021

(51) Int. Cl.
*B66B 13/26* (2006.01)
*B66B 13/30* (2006.01)

(52) U.S. Cl.
CPC ..... *B66B 13/26* (2013.01); *B66B 13/30* (2013.01)

(58) Field of Classification Search
CPC ..... B66B 5/0031; B66B 13/26; B66B 5/0018; B66B 5/0012; B66B 13/22; B66B 13/06;
(Continued)

(56) References Cited

U.S. PATENT DOCUMENTS

2002/0166732 A1* 11/2002 Horbrugger ..... B66B 13/22 187/316
2021/0179390 A1* 6/2021 Koketsu ..... B66B 13/30

FOREIGN PATENT DOCUMENTS

CN 1962385 A 5/2007
CN 101570297 A 11/2009
(Continued)

OTHER PUBLICATIONS

Chinese Office Action dated Jul. 15, 2022 in corresponding Chinese Patent Application No. 201880098654.9 (with machine-generated English translation), 18 pages.
(Continued)

*Primary Examiner* — Marlon T Fletcher
(74) *Attorney, Agent, or Firm* — XSENSUS LLP

(57) ABSTRACT

An object of the present application is to obtain a door-pinch detection device and an elevator door device that enable detection of a string-shaped object. Accordingly, the elevator door device of the present application includes: a door panel of an elevator; and a first attachment section and a second attachment section installed on at least either one of a front face or a back face of the door panel, the first attachment section including a pressure sensor, the second attachment section including a repulsive member installed in a manner for the pressure sensor to be housed therein when doors of the elevator are closed, thus enabling adjustment of an angle of the pressure sensor relative to the door panel. Therefore, door-pinch of an alien object can be detected with an improved accuracy.

16 Claims, 9 Drawing Sheets

(58) Field of Classification Search
CPC ..... B66B 13/12; B66B 11/0206; B66B 13/00; B66B 13/02; B66B 9/0807
See application file for complete search history.

(56) References Cited

FOREIGN PATENT DOCUMENTS

| | | | | | |
|---|---|---|---|---|---|
| CN | 102414114 | A | * | 4/2012 | ..... B66B 13/12 |
| CN | 105858423 | A | * | 8/2016 | |
| CN | 105858423 | B | * | 9/2017 | |
| CN | 107954299 | A | * | 4/2018 | ..... B66B 13/26 |
| CN | 108100836 | A | * | 6/2018 | ..... B66B 13/185 |
| CN | 213595683 | U | * | 7/2021 | |
| CN | 214087250 | U | * | 8/2021 | |
| EP | 2138442 | A1 | * | 12/2009 | ..... B66B 13/12 |
| JP | 4-16489 | A | | 1/1992 | |
| JP | 11-263564 | A | | 9/1999 | |
| JP | 2006-248757 | A | | 9/2006 | |
| JP | 2007-131389 | A | | 5/2007 | |
| JP | 2008-143619 | A | | 6/2008 | |
| JP | 2010-126323 | A | | 6/2010 | |
| JP | 2011-116493 | A | | 6/2011 | |
| JP | 2016-164091 | A | | 9/2016 | |
| KR | 101654712 | B1 | * | 6/2016 | |
| KR | 101732337 | B1 | * | 3/2017 | |
| KR | 20210109373 | A | * | 9/2021 | |
| WO | WO-0196226 | A1 | * | 12/2001 | ..... B66B 13/26 |
| WO | WO-03069104 | A1 | * | 8/2003 | ..... B66B 13/26 |
| WO | WO-2007037948 | A2 | * | 4/2007 | ..... B66B 13/26 |
| WO | WO-2020003448 | A1 | * | 1/2020 | |
| WO | WO-2020084679 | A1 | * | 4/2020 | ..... B66B 13/26 |

OTHER PUBLICATIONS

International Search Report and Written Opinion dated Jan. 29, 2019, received for PCT Application No. PCT/JP2018/039310, Filed on Oct. 23, 2018, 9 pages including English Translation.

* cited by examiner

DOOR-PINCH DETECTION DEVICE AND ELEVATOR DOOR DEVICE

CROSS-REFERENCE TO RELATED APPLICATION

The present application is based on PCT filing PCT/JP2018/039310, filed Oct. 23, 2018, the entire contents of which are incorporated herein by reference.

FIELD

The present invention relates to a door-pinch detection device and an elevator door device.

BACKGROUND

An elevator door device is equipped with a variety of sensors that detect an alien object likely to get pinched between doors when the doors are closed for the purpose of ensuring safety for boarding and alighting passengers. A thin elongated object and a string-shaped object to be attached to a pet such as a dog are relatively difficult for the sensors to detect due to the small diameters thereof.

As a method for solving such a problem, for example, a method as in PTL 1 has been known, where a pressure sensor is provided in a vertical direction on a door hitting face of one of doors while a cushioning member is provided at an end portion of the other door.

In PTL 1, the pressure sensor detects a pressure resulting from an elongated object or a string-shaped object, which intersects the door hitting face, being pressed via the cushioning member to detect an alien object.

In addition, for example, PTL 2 discloses a pressure-sensitive sensor for detecting a string-shaped object on a side face of one of doors. The pressure-sensitive sensor is fixed to a car door via a fixation hole made in a receiving member.

CITATION LIST

Patent Literature

[PTL 1] JP 2008-143619 A (see paragraph 0024, FIG. 2, etc.)
[PTL 2] JP 2007-131389 A (see paragraph 0015, FIG. 4, etc.)

SUMMARY

Technical Problem

Meanwhile, to reduce a door hitting sound caused immediately before door panels of an elevator are fully closed, the two door panels are often installed with door hitting faces thereof inclined in an inverted V-shape and thus the door hitting faces of the doors on both sides are unlikely to be parallel with each other. In a case where the pressure sensor and the cushioning member of PTL 1 are installed with the door hitting faces of the doors on both sides being not in parallel with each other, one of a lower side and an upper side of the pressure sensor is spaced from the cushioning member at a distance of several millimeters. If the lower side of the pressure sensor is spaced from the cushioning member, the door-pinch of an alien object cannot be detected at the lower side of the pressure sensor due to a failure of the pressure sensor and the cushioning member to contact with each other even when the doors are closed, although the door-pinch of an alien object can be correctly detected at the upper side of the pressure sensor.

Accordingly, in installing the pressure sensor and the cushioning member in an existing elevator, it is necessary to reinstall the doors to adjust the angles of the doors, which makes the installation of the door-pinch detection device time-consuming.

Further, PTL 2, which discloses the receiving member having the fixation hole for attaching the pressure-sensitive sensor to the car door, is silent about adjusting the inclination of the pressure-sensitive sensor with respect to the inclination of the door of an elevator. Therefore, in a case where the door hitting faces are attached while being inclined in an inverted V-shape, the door-pinch of an alien object fails to be correctly detected.

An object of the present application is to obtain a door-pinch detection device and an elevator door device that solve the above-described problems and enable detection of a string-shaped object.

Solution to Problem

A door-pinch detection device of the present application includes: a first attachment section and a second attachment section attached to at least either side face of a front face or a back face of a door panel of an elevator, the first attachment section including a pressure sensor, the second attachment section including a repulsive member installed in a manner for the pressure sensor to be housed therein; and at least either one of a first angle adjustment section provided in the first attachment section to adjust an attachment angle of the pressure sensor with respect to the door panel for installation or a second angle adjustment section provided in the second attachment section to adjust an attachment angle of the repulsive member with respect to the door panel for installation.

Further, an elevator door device of the present application includes: a door panel of an elevator; a door-pinch detection device including a first attachment section and a second attachment section installed on at least either one of a front face or a back face of the door panel, the first attachment section including a pressure sensor, the second attachment section including a repulsive member installed in a manner for the pressure sensor to be housed therein when doors of the elevator are closed; and a third angle adjustment section provided in the door panel to adjust an attachment angle of at least either one of the first attachment section or the second attachment section for installation.

Advantageous Effects of Invention

The door-pinch detection device and the elevator door device according to the present application enable the adjustment of an angle of the pressure sensor relative to the door panel, thus enabling an improvement in accuracy in detecting the door-pinch of an alien object.

DESCRIPTION OF EMBODIMENTS

Embodiment 1

A door-pinch detection device 10 and a door device 100 for an elevator according to Embodiment 1 of the present application will be described below with reference to the drawings.

Figure 1:
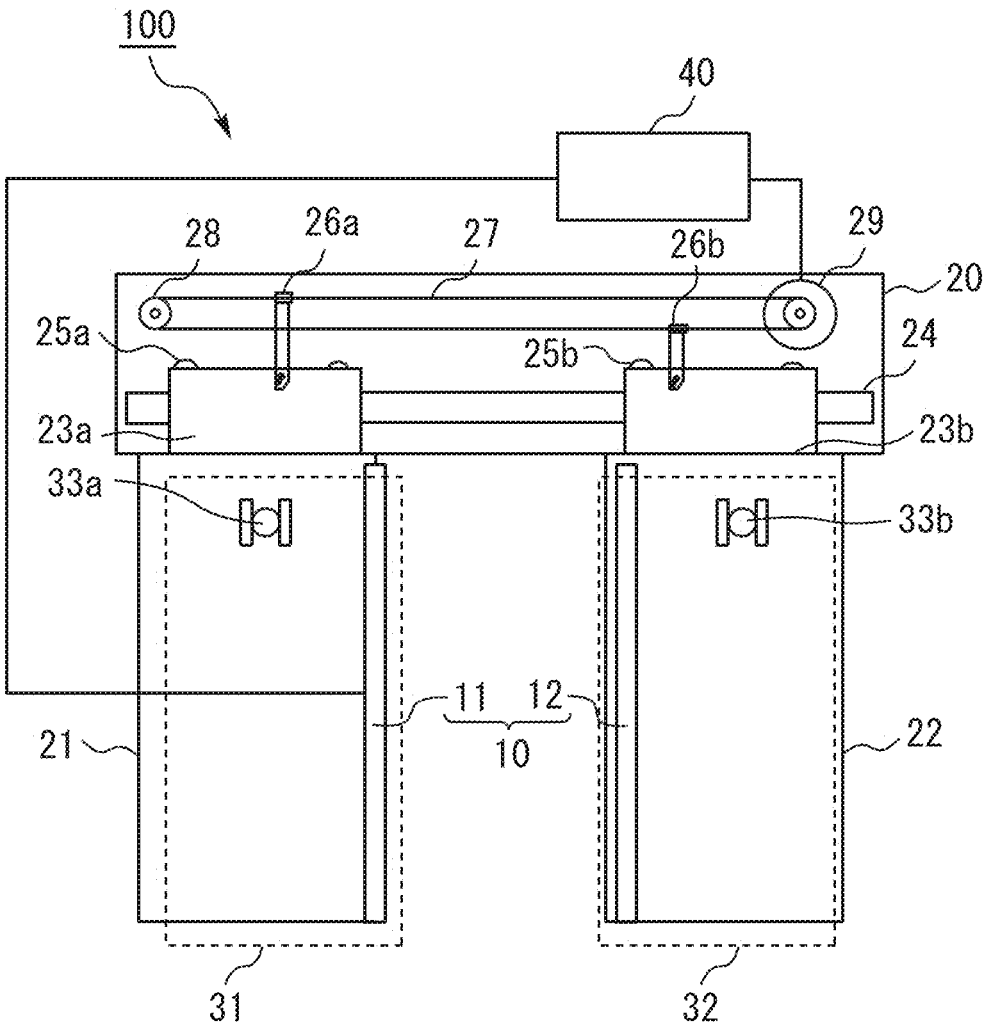
FIG. 1 is block diagram of a door device including a door-pinch detection device of the present application.

FIG. 1 shows a structure of the door device 100 for an elevator of Embodiment 1 of the present application. The door device 100 is a door device for an elevator car. The door device 100 includes the door-pinch detection device 10. The door-pinch detection device 10 includes a first attachment member 11 (first attachment section) and a second attachment member 12 (second attachment section). The first attachment member 11 is attached to a car-side door panel 21, while the second attachment member 12 is attached to a car-side door panel 22.

The car-side door panels 21 and 22 are coupled to a door device support frame 20 provided above. A coupler 23*a*, a coupler 23*b*, a rail 24, a door hanger 25*a*, a door hanger 25*b*, a hanging handle 26*a*, a hanging handle 26*b*, a belt 27, a lazy-side pulley 28, and a motor 29 are provided in the door device support frame 20.

The car-side door panels 21 and 22 are fixed to the coupler 23*a* and the coupler 23*b*, respectively. The coupler 23*a* and the coupler 23*b* move right and left in FIG. 1 along the rail 24, which is horizontally provided, via the door hanger 25*a* and the door hanger 25*b*.

The door hanger 25*a* and the door hanger 25*b* roll right and left on the rail 24. The hanging handle 26*a* is attached to the coupler 23*a*. The hanging handle 26*b* is attached to the coupler 23*b*. The hanging handle 26*a* is fixed to the coupler 23*a* at one end while being fixed to the belt 27 at the other end. The hanging handle 26*b* is fixed to the coupler 23*b* at one end while being fixed to the belt 27 at the other end. The belt 27 is an endless belt wound on the lazy-side pulley 28 and a pulley of the motor 29.

The lazy-side pulley 28 and the motor 29 are horizontally fixed to the door device support frame 20. The belt 27 rotates with the driving of the motor 29. The hanging handle 26*a* is fixed to the belt 27 on an upper side relative to the lazy-side pulley 28 and the pulley of the motor 29. The hanging handle 26*b* is fixed to the belt 27 on the lower side relative to the lazy-side pulley 28 and the pulley of the motor 29.

Thus, when the belt 27 rotates clockwise, the car-side door panel 21 moves right in FIG. 1 and the car-side door panel 22 moves left. Meanwhile, when the belt 27 rotates counterclockwise, the car-side door panel 21 moves left in FIG. 1 and the car-side door panel 22 moves right.

Such a structure causes a torque of the motor 29 to be transmitted to each of the car-side door panels 21 and 22. Further, the open and close motion of the car-side door panels 21 and 22 is enabled by switching the rotation direction of the motor 29.

Meanwhile, dotted lines in FIG. 1 show hall-side door panels 31 and 32. The hall-side door panels 31 and 32 are removably fixed to the car-side door panels 21 and 22 by a coupling device 33*a* and a coupling device 33*b*.

During the open and close motion of the car-side door panels 21 and 22, since the hall-side door panels 31 and 32 are fixed to the car-side door panels 21 and 22, the hall-side door panels 31 and 32 also perform an open and close motion with the open and close motion of the car-side door panels 21 and 22.

A pressure sensor 11*a* of the first attachment member 11 and the motor 29 are coupled to a door controller 40. When a car arrives at each floor, the door controller 40 transmits a control instruction to the motor 29. The door controller 40 also transmits a control instruction to the motor 29 on the basis of an operation of an operating panel (not shown) in the car performed by a user.

Further, the first attachment member 11 transmits a detection result to the door controller 40. When it is detected that an alien object is pinched by the first attachment member 11 during the door close motion of the car-side door panels 21 and 22, the door controller 40 transmits a signal for stopping the door close motion or a signal for switching to the door open motion to the motor 29.

A detailed configuration of each of the first attachment member 11 and the second attachment member 12 will be described later.

It should be noted that the door controller 40 manages the open and close motion of the car-side door panels 21 and 22 while communicating with a control panel (not shown) that manages the motion of the whole of an elevator. The control panel controls the driving of a traction machine of the elevator on the basis of, for example, call registration and destination floor registration.

Here, the inclination of each of the car-side door panels 21 and 22 and the attachment angle of each of the first attachment member 11 and the second attachment member 12 will be described with reference to FIG. 2*a*.

To reduce a door hitting sound caused immediately before full close, the car-side door panel 21 is attached to the coupler 23*a* with a slight counterclockwise inclination.

Meanwhile, the car-side door panel 22 is attached to the coupler 23*b* with a slight clockwise inclination.

That is, the door hitting face 21*a* of the car-side door panel 21 and the door hitting face 22*a* of the car-side door panel 22 are in a V-shape.

Thus, even when a lower end of the door hitting face 21*a* and a lower end of the door hitting face 22*a* come into contact with each other during the door close motion, an upper end of the door hitting face 21*a* and an upper end of the car-side door panel 22 are spaced from each other by several millimeters.

Since the car-side door panels 21 and 22 are installed while being inclined in opposite directions to each other as described, the entire face of the door hitting face 21*a* and the entire face of the door hitting face 22*a* are prevented from simultaneously coming into contact with each other during the door close motion, thereby making it possible to reduce a contact sound caused by the door hitting faces 21*a* and 22*a*.

However, attaching the first attachment member 11 and the second attachment member 12 respectively to the car-side door panels 21 and 22 in parallel with the door hitting faces 21*a* and 22*a* entails a problem that the accuracy of the first attachment member 11 in detecting an alien object is different between upper portion and lower portion of each of the car-side door panels 21 and 22.

Hence, it is necessary to attach the first attachment member 11 and the second attachment member 12 to the car-side door panels 21 and 22 at angles different from those of the door hitting faces 21*a* and 22*a*.

Accordingly, in the present application, the first attachment member 11 and the second attachment member 12 are attached while being angled with respect to the door hitting faces 21*a* and 22*a*. The first attachment member 11 and the second attachment member 12 are attached such that they are parallel with each other when doors of the elevator are closed.

It should be noted that the configuration where the door hitting face 21*a* of the car-side door panel 21 and the door hitting face 22*a* of the car-side door panel 22 are in a V-shape is described with reference to FIG. 2*a*. However, the door hitting faces 21*a* and 22*a* are sometimes in an inverted V-shape when the doors are closed as shown in FIG. 2*b* depending on the installation manner of the car-side door panels 21 and 22. Even in such a case, the first attachment member 11 and the second attachment member 12 are attached with respect to the door hitting faces 21*a* and 22*a* such that the first attachment member 11 and the second attachment member 12 are in parallel with each other when the doors are closed.

Figure 2A:
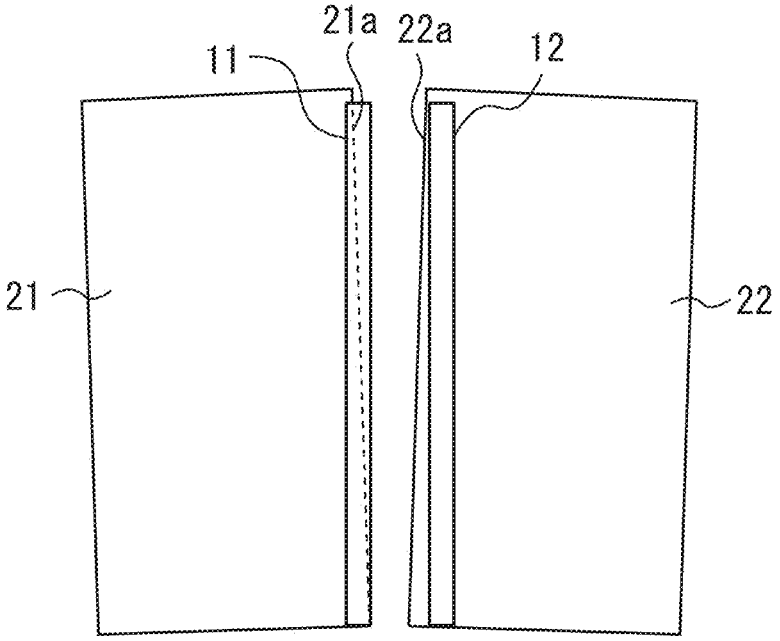
FIG. 2*a* is a figure showing the inclination of a car-side door panel of a door-pinch detection device of Embodiment 1 of the present application.
Figure 2B:
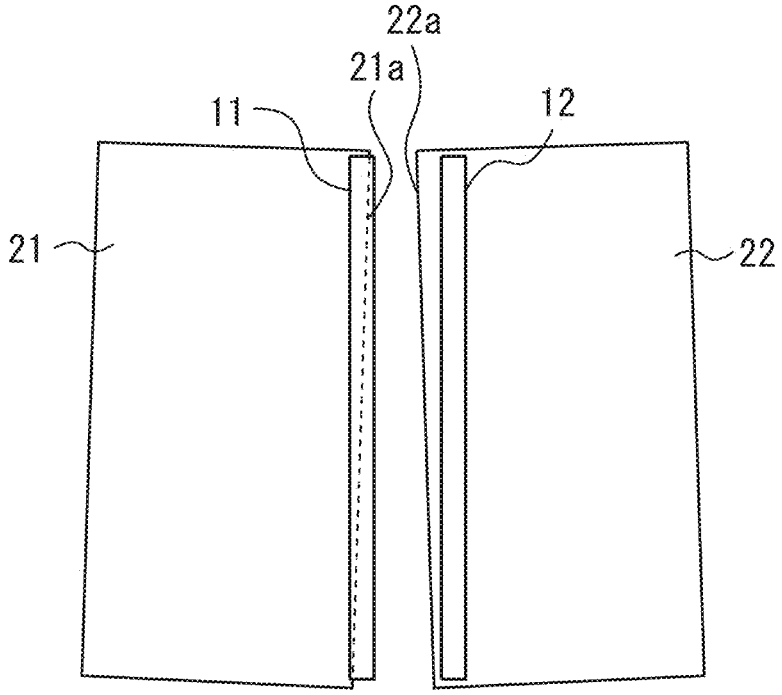
FIG. 2*b* is a figure showing the inclination of the car-side door panel of the door-pinch detection device of Embodiment 1 of the present application in another case.

Further, even in a case where the car-side door panels 21 and 22 are installed with the door hitting faces 21*a* and 22*a* being in parallel with each other, the car-side door panels 21 and 22 are sometimes inclined in a V-shape or an inverted V-shape as shown in FIG. 2*a* or FIG. 2*b* during the door close motion. Accordingly, with the inclination of each of the car-side door panels 21 and 22 during the door close motion taken into consideration in advance, the first attachment member 11 and the second attachment member 12 are attached while being inclined with respect to the door hitting faces 21*a* and 22*a*.

Figure 3:
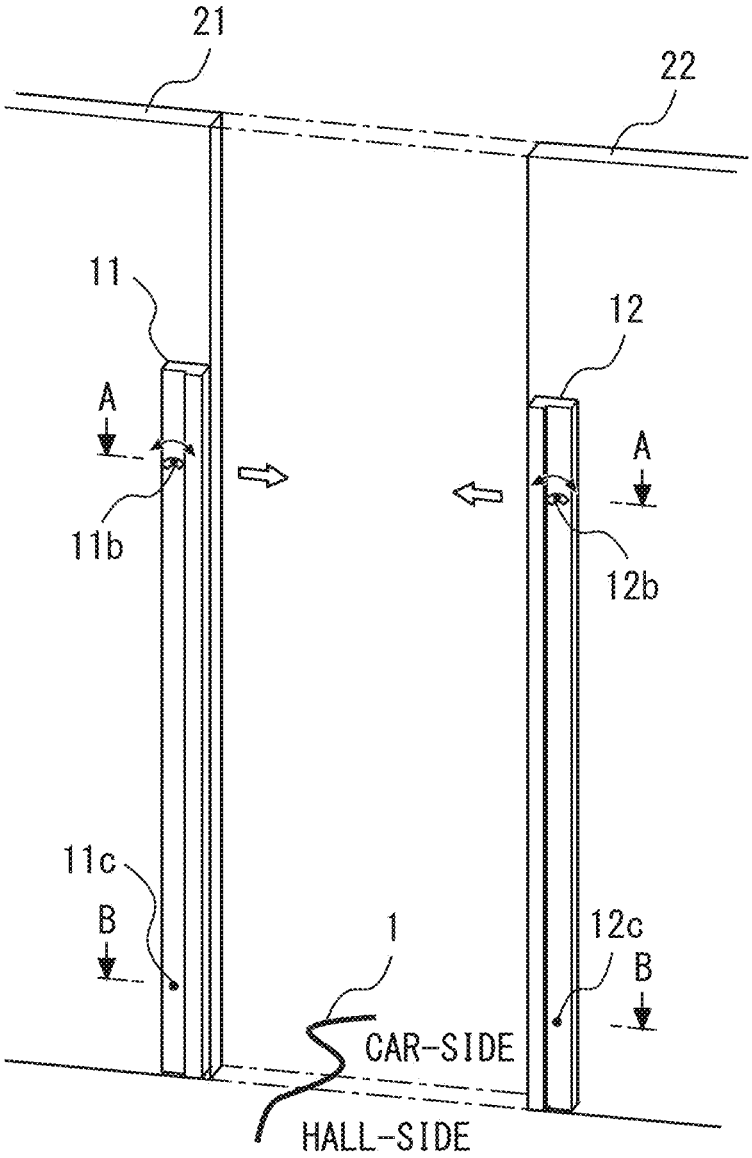
FIG. 3 is a perspective drawing of a door device including the door-pinch detection device of Embodiment 1 of the present application.
Figure 4A:
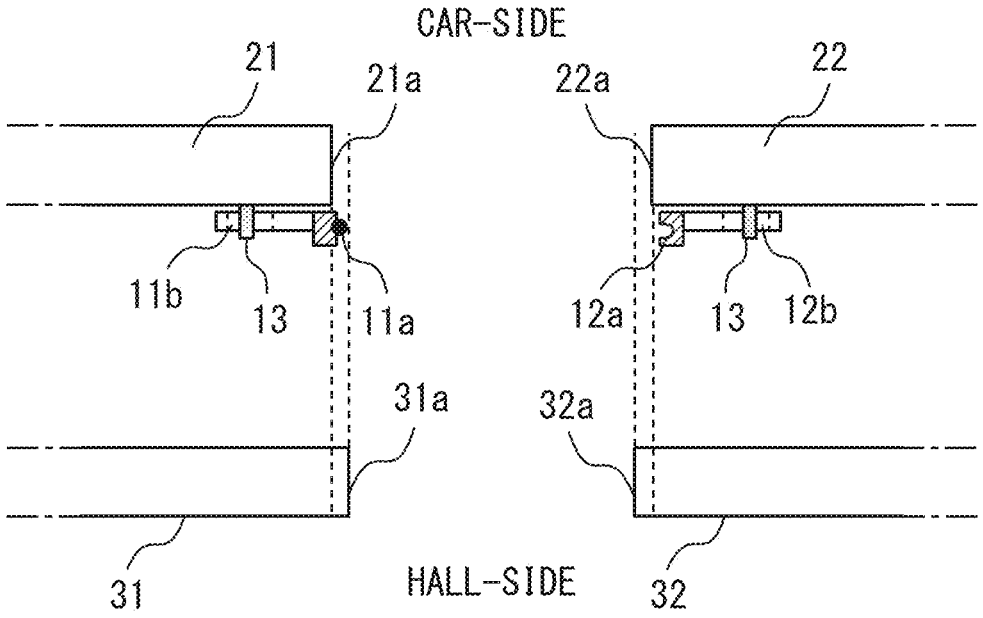
FIG. 4*a* is a sectional drawing of the door device including the door-pinch detection device of Embodiment 1 of the present application.
Figure 4B:
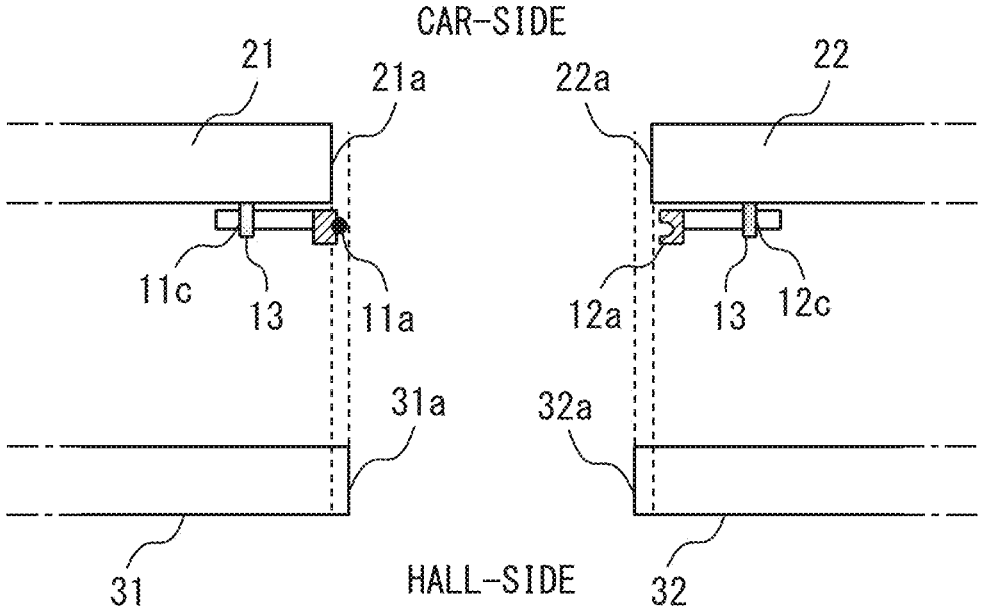
FIG. 4*b* is a sectional drawing of the door device including the door-pinch detection device of Embodiment 1 of the present application.

FIG. 3 is a perspective drawing of the car-side door panels 21 and 22. FIG. 4*a* is an A-A sectional drawing in FIG. 3 and FIG. 4*b* is a B-B sectional drawing in FIG. 3. FIG. 3 is a perspective drawing of the car-side door panels 21 and 22 with the door hitting faces 21*a* and 22*a* inclined in a V-shape as shown in FIG. 2*a*. In FIG. 4*a* and FIG. 4*b*, an upper side in the figure is a car side and a lower side in the figure is a hall side. It should be noted that FIG. 3 shows an alien object, namely, string 1, between the car-side door panels 21 and 22.

A detailed configuration of each of the first attachment member 11 and the second attachment member 12 will be described. The pressure sensor 11*a* is provided at a distal end of the first attachment member 11. An elongated hole 11*b* (first angle adjustment section) and a pin hole 11*c* are made in the first attachment member 11. The first attachment member 11 is fixed to the car-side door panel 21 with a fitting 13, such as a pin, a screw, or bolt and nut, penetrating each of the elongated hole 11*b* and the pin hole 11*c*. The elongated holes 11*b* and 12*b* are each a hole elongated in the opening-closing direction of the doors.

A repulsive member 12*a* is provided at a distal end of the second attachment member 12. Similarly to the first attachment member 11, the elongated hole 12*b* (second angle adjustment section) and a pin hole 12*c* are made in a hall-side side face of the second attachment member 12. The second attachment member 12 is fixed to the car-side door panel 22 with the fitting 13 penetrating each of the elongated hole 12*b* and the pin hole 12*c*.

By adjusting the position for the fitting 13 to penetrate in each of the elongated holes 11*b* and 12*b*, which are arc-shaped elongated holes, it is possible to adjust the attachment angle of the first attachment member 11 relative to the first attachment member 11 and the attachment angle of the second attachment member 12 relative to the second attachment member 12.

The first attachment member 11 and the second attachment member 12 are attached to hall-side side faces (back faces) of the car-side door panels 21 and 22, so that a passenger in the car cannot usually touch the door hitting face 21*a*. Further, when the hall-side door panels 31 and 32 are opened, the attachment angle of each of the first attachment member 11 and the second attachment member 12 can be adjusted from the hall.

However, although the configuration where the door-pinch detection device 10 is attached to the back faces of the car-side door panels 21 and 22 is described in the present application, the door-pinch detection device 10 may be attached to car-side side faces (front faces) of the car-side door panels 21 and 22.

It should be noted that although the pin holes 11*c* and 12*c* are each a pin hole, the pin holes 11*c* and 12*c* may each be an elongated hole as the elongated holes 11*b* and 12*b*. With the pin holes 11*c* and 12*c* each being an elongated hole, it is possible to adjust the projection distance of the pressure sensor 11*a* relative to the door hitting face 21*a* and the retraction distance of the repulsive member 12*a* relative to the door hitting face 22*a*.

In the case shown in FIG. 4*a* and FIG. 4*b*, the projection distance refers to a distance from the door hitting face 21*a* to a distal end of the pressure sensor 11*a*. The retraction distance refers to a distance from the door hitting face 22*a* to a distal end of the second attachment member 12.

The pressure sensor 11*a* is a string-shaped cylinder. A wire where a certain voltage or current is to flow is provided in the pressure sensor 11*a*. When an alien object comes into contact with the pressure sensor 11*a*, the shape of the pressure sensor 11*a* deforms, causing a change in a resistance value of the current flowing in the pressure sensor 11*a*. The alien object can thus be detected.

The pressure sensor 11*a* is fixed to a distal end face of the first attachment member 11 with a bonding material, a tape, or the like.

The repulsive member 12*a* is machined into a shape that covers the pressure sensor 11*a* when the car-side door panels 21 and 22 are fully closed.

The repulsive member 12*a* is provided with a recessed portion. When the car-side door panels 21 and 22 are fully closed, the pressure sensor 11*a* is received in the recessed portion of the repulsive member 12*a*. Thus, in the absence of an alien object, no pressure is applied to the pressure sensor 11*a*.

In a case where a string-shaped alien object is pinched between the car-side door panels 21 and 22, the repulsive member 12*a* causes a tensile force to be generated in the string-shaped alien object. Thus, the tensile force generated in the alien object causes a pressure to be applied to the pressure sensor 11*a*, so that the alien object can be detected.

It should be noted that the first attachment member 11 and the second attachment member 12 are attached in a vertical direction over a range from lower ends of the car-side door panels 21 and 22 to a predetermined height (for example, 1.0 m to 1.5 m). This is because it is less necessary to reach a height higher than the level of the hand of a person, i.e., a height of 1.5 m or higher, with the assumption that a string-shaped alien object is usually a string for leashing a pet such as a dog.

Further, as shown in FIG. 4*a* and FIG. 4*b*, the pressure sensor 11*a* is installed at a projected position in a door close direction with respect to the door hitting face 21*a*, while the repulsive member 12*a* is installed at a retracted position with respect to the door hitting face 22*a*.

Installing at such positions makes, when a string-shaped alien object is pinched, a tensile force likely to be generated in the alien object, so that the accuracy of the pressure sensor 11*a* in detecting an alien object can be improved.

With the pressure sensor 11*a* projected with respect to the door hitting face 31*a*, the accuracy of the pressure sensor 11*a* in detecting an alien object can be further improved.

Inversely, the pressure sensor 11*a* may be installed at a retracted position in the door close direction with respect to the door hitting face 21*a*, while the repulsive member 12*a* is installed at a projected direction with respect to the door hitting face 22*a*.

Installing at such positions prevents the pressure sensor 11*a* from projecting with respect to the door hitting face 21*a*, so that a failure of the pressure sensor 11*a* is less likely to be caused.

It should be noted that since the door hitting faces 21*a* and 22*a* are inclined in a V-shape in FIG. 4*a* and FIG. 4*b*, the projection distance of the pressure sensor 11*a* relative to the door hitting face 21*a* in FIG. 4*b* is smaller than that in FIG. 4*a*.

Assuming that the car-side door panel 21 is divided into at least upper side and lower side, at least the lower side, the pressure sensor 11*a* projects with respect to the door hitting face 21*a*. Such a configuration makes, when a string-shaped alien object is pinched, a tensile force likely to be generated in the alien object, so that the accuracy of the pressure sensor 11*a* in detecting an alien object can be improved.

As described above, in Embodiment 1, the first attachment member 11 and the second attachment member 12 are provided with the angle adjustment sections, namely, the elongated holes 11*b* and 12*b*. This makes it possible to adjust the attachment angle of each of the first attachment member 11 and the second attachment member 12 even though the door hitting faces 21*a* and 22*a* are not in parallel but inclined, thus enabling an alien object pinched between the car-side door panels 21 and 22 to be detected with an improved accuracy.

It should be noted that although the configuration where the first attachment member 11 and the second attachment member 12 are both provided with the angle adjustment sections, namely, the elongated holes 11*b* and 12*b*, is described in Embodiment 1, it is sufficient if either one of the first attachment member 11 and the second attachment member 12 is provided with the angle adjustment section.

Further, in a case where the pressure sensor 11*a* and the repulsive member 12*a* are directly attached to the door hitting faces 21*a* and 22*a*, a door width is increased by an amount corresponding to the width of each of the first attachment member 11 and the second attachment member 12, so that it is necessary to adjust the movable distance of each of the car-side door panels 21 and 22 during the open and close motion or replace them with door panels each having a width smaller by an amount corresponding to the width of each of the first attachment member 11 and the second attachment member 12.

However, in the configuration of the present application, the first attachment member 11 and the second attachment member 12 are fixed to not the distal end faces of the car-side door panels 21 and 22 but the side faces thereof, so that neither adjustment of the movable distance of each of the car-side door panels 21 and 22 nor replacement of the door panels is necessary.

Therefore, in newly attaching the door-pinch detection device of the present application to an elevator that has already been installed, the attachment work can be easily performed.

Embodiment 2

In Embodiment 1, description is made on the configuration where the first attachment member 11 and the second attachment member 12 are provided with the elongated holes 11*b* and 12*b* to allow the attachment angles of the first attachment member 11 and the second attachment member 12 to be adjusted.

In Embodiment 2, description will be made on a configuration where the angles of the first attachment member 11 and the second attachment member 12 relative to the door hitting faces 21*a* and 22*a* are automatically adjusted in accordance with the door close motion.

Figure 5:
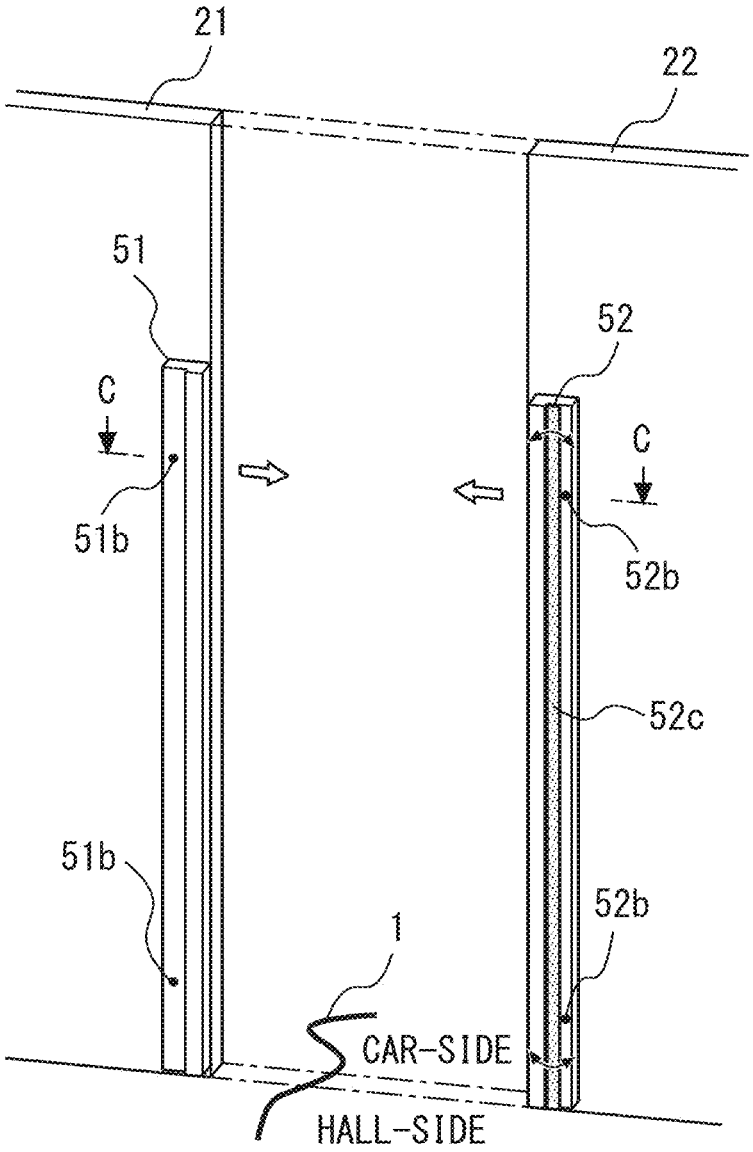
FIG. 5 is a perspective drawing of a door device including a door-pinch detection device of Embodiment 2 of the present application.
Figure 6:
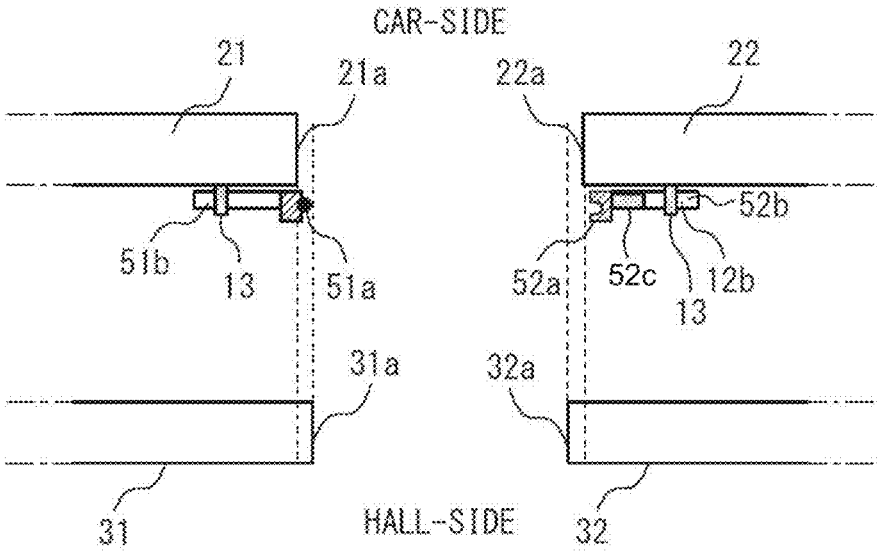
FIG. 6 is a sectional drawing of the door device including the door-pinch detection device of Embodiment 2 of the present application.

FIG. 5 is a perspective drawing of a door device including a door-pinch detection device of Embodiment 2. FIG. 6 is a C-C sectional drawing of FIG. 5.

In Embodiment 2, a first attachment member 51 and a second attachment member 52 are attached to the car-side door panels 21 and 22, respectively.

The second attachment member 52 includes a fixation portion fixed with the fitting 13, a repulsive member 52*a*, and an intermediate portion provided between the fixation portion and the repulsive member 52*a*.

An adjustment member 52*c* (adjustment member) including an elastic blank material is inserted in the intermediate portion of the second attachment member 52. The blank material of the adjustment member 52*c* is, for example, a resin or the like.

An upper portion or a lower portion of the adjustment member 52*c* is extended and retracted with respect to a door hitting face by a door hitting force to cause the second attachment member 52 to swingably move to enable the attachment angle to be adjusted.

The door close force of each of the car-side door panels 21 and 22 during door full close is set larger than the repulsive force of the pressure sensor 51*a*.

The repulsive force of the repulsive member 52*a* is set larger than the motion sensitivity of a pressure sensor to enable a string-shaped alien object to be detected by the pressure sensor. However, since an excessive repulsive force of the repulsive member 52*a* is unlikely to allow the doors (the car-side door panels 21 and 22) to be closed, a door pressing force for full close is set larger than the repulsive force of the repulsive member 52*a*. The relationship of the repulsive force of the pressure sensor 51*a*, the repulsive force of the repulsive member 52*a*, and the door pressing force satisfies the following Expressions (1) and (2).

The repulsive force of the pressure sensor 51*a*<the repulsive force of the adjustment member 52*c* (Expression 1)

The repulsive force of the adjustment member 52*c*<the door pressing force (Expression 2)

A unit for the repulsive force of the pressure sensor 51*a*, the repulsive force of the repulsive member 52*a*, and the door pressing force is N.

In Expression W, the repulsive force of the pressure sensor 51*a* is a value given by multiplying the motion sensitivity of the pressure sensor 51*a* by the contact area (mm^2) of a pinched string or the diameter (mm) of the string. For example, in a case where the motion sensitivity of the pressure sensor 51*a* is a value calculated by dividing the force (N) by the area (mm^2), a value given by multiplying the motion sensitivity (N/mm^2) by the contact area (mm^2) of the string is the repulsive force of the pressure sensor 51*a*. Meanwhile, for example, in a case where the motion sensitivity of the pressure sensor 51*a* is a value calculated by dividing the force (N) by a length (mm), a value given by multiplying the motion sensitivity (N/mm) by the contact length (mm) of the string is the repulsive force of the pressure sensor 51*a*.

The repulsive force of the adjustment member 52*c* is a value given by multiplying the elastic force (N/mm^2) of the adjustment member 52*c* by the contact area (mm^2) of the string.

That is, the motion sensitivity (N/mm^2) of the pressure sensor 51*a* is a value smaller than the elastic force (N/mm^2) of the adjustment member 52*c*.

It should be noted that although the repulsive force of the pressure sensor 51*a* and the repulsive force of the adjustment member 52*c* are each a value dependent on the thickness of a string, the contact area and the contact distance of the string are the same between the pressure sensor 51*a* and the adjustment member 52*c*, so that a blank material that satisfies the conditions of Expression (1) may be selected by comparing the motion sensitivity of the pressure sensor 51*a* and the elastic force of the adjustment member 52*c* with each other. In other words, the adjustment member 52*c* includes a blank material harder than that of the pressure sensor 51*a*.

In Expression (2), the repulsive force of the adjustment member 52*c* is a force (N) with which the entire adjustment member 52*c* pushes back the door panels 21 and 22 when the doors are fully closed, and a door pressing force is a force (N) with which the door panels 21 and 22 are pushed when the doors are fully closed. Since door panels 21 and 22 cannot be closed if the blank material of the adjustment member 52*c* is too hard, a blank material that satisfies the conditions of Expression (2) is selected or the door pressing force is increased.

As described above, in the configuration of Embodiment 2, the adjustment member 52*c* is provided at the intermediate portion, which is not fixed with the fitting 13, of the second attachment member 52. This causes the repulsive member 52*a* to automatically rotate by virtue of the pressing force of the car doors applied when the car-side door panels 21 and 22 are fully closed, enabling the repulsive member 52*a* to be parallel with respect to the pressure sensor 51*a*.

It should be noted that the adjustment member 52*c* may include a spring or a leaf spring instead of a resin. Further, the fitting 13 inserted in the pin hole 52*b* may include an elastic member with an elastic force.

It should be noted that although the configuration where the adjustment member 52*c* is inserted in the intermediate portion of the second attachment member 52 is described, an adjustment member may be inserted in an intermediate portion of the first attachment member 51. Alternatively, an adjustment member may be inserted in the intermediate portion of each of the first attachment member 51 and the second attachment member 52.

Embodiment 3

Figure 7:
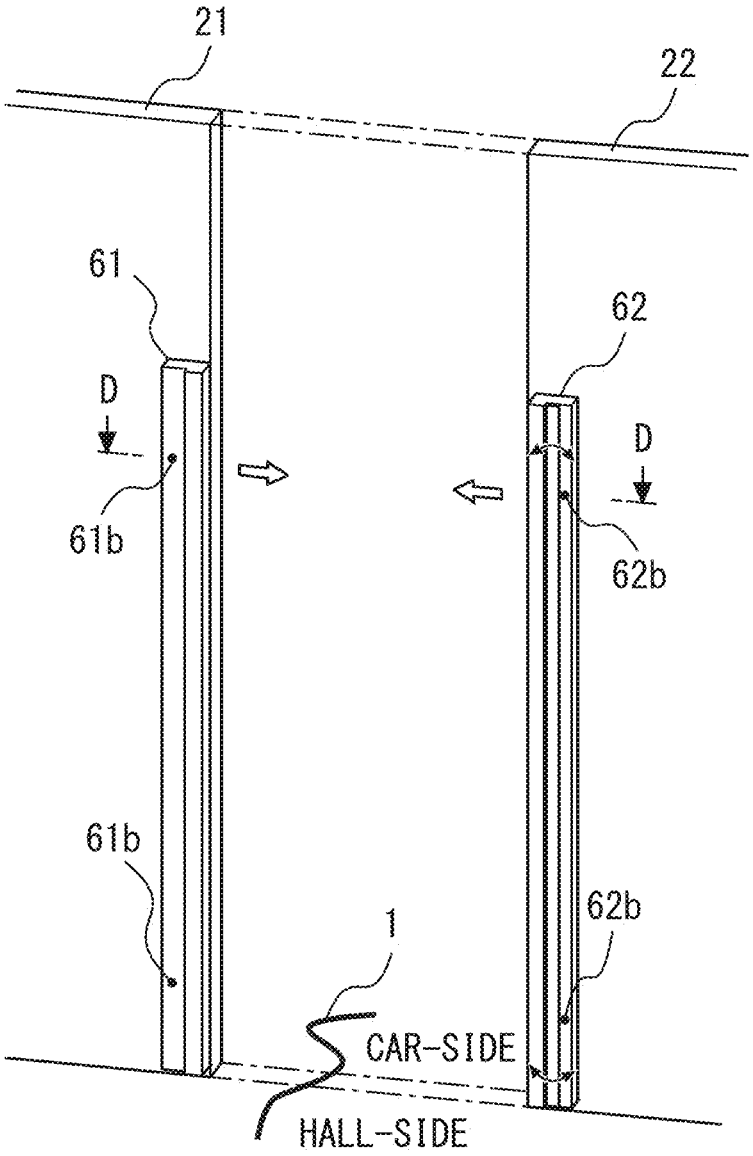
FIG. 7 is a perspective drawing of a door device including a door-pinch detection device of Embodiment 3 of the present application.
Figure 8:
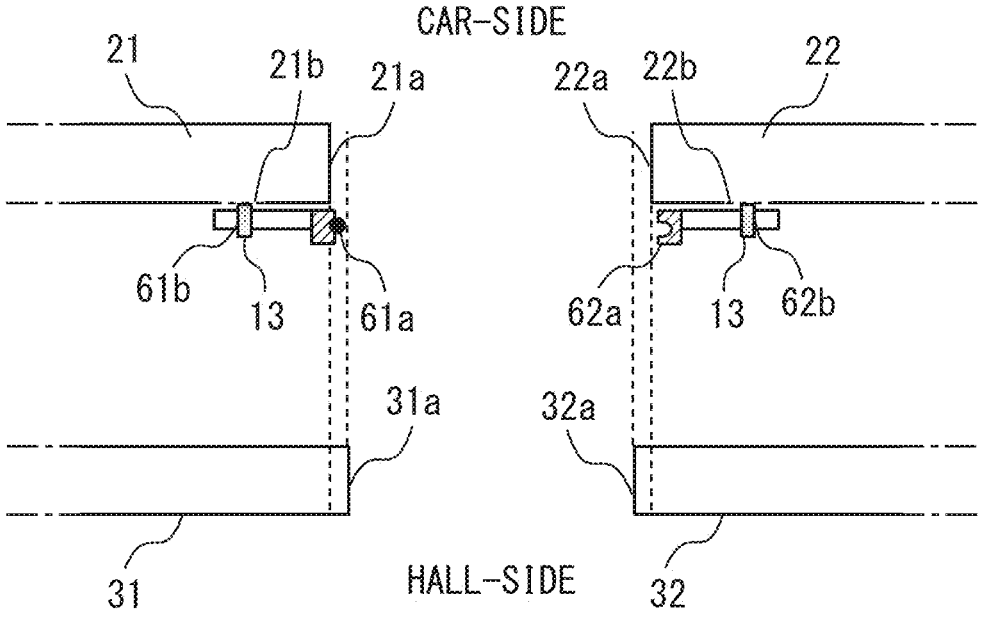
FIG. 8 is a sectional drawing of the door device including the door-pinch detection device of Embodiment 3 of the present application.

While the configuration where the first attachment member 11, the second attachment member 12, the first attachment member 51, and the second attachment member 52 are each provided with an angle adjustment section is described in Embodiments 1 and 2, a configuration where the car-side door panels 21 and 22 are each provided with an angle adjustment section will be described in Embodiment 3 with reference to FIG. 7 and FIG. 8.

In Embodiment 3, respective third angle adjustment sections, namely, elongated holes 21*b* and 22*b*, are made in the car-side door panels 21 and 22. The elongated holes 21*b* and 22*b* are each an arc-shaped elongated hole.

Respective pin holes 61*b* and 62*b* are made in the first attachment member 61 and the second attachment member 62. The first attachment member 61 and the second attachment member 62 are fixed to the car-side door panels 21 and 22 with the fittings 13 inserted in the pin holes 61*b* and 62*b*.

With the holes made in the car-side door panels 21 and 22 each being an arc-shaped elongated hole, it is possible to adjust the attachment angles and the attachment positions of the first attachment member 61 and the second attachment member 62. The attachment positions refer to the projection distance of the pressure sensor 61*a* relative to the door hitting face 21*a* and the retraction distance of the repulsive member 62*a* relative to the door hitting face 22*a*.

As described above, in the configuration of Embodiment 3, although neither the first attachment member 61 nor the second attachment member 62 has an elongated hole and neither the first attachment member 61 nor the second attachment member 62 includes an adjustment member, the angle adjustment sections, namely, the elongated holes 21*b* and 22*b*, provided in the car-side door panels 21 and 22 make it possible to adjust the attachment angles of the first attachment member 61 and the second attachment member 62.

It should be noted that the pin holes 61*b* and 62*b* may each be an elongated hole as in Embodiment 1 instead of a pin hole. With the pin holes 61*b* and 62*b* each being an elongated hole, it is possible to more easily adjust the angles and the positions of the car-side door panels 21 and 22 in attaching them to the first attachment member 61 and the second attachment member 62.

Further, in Embodiment 3, the fittings 13 each include a resin, a spring, or the like with an elastic force, so that the fittings 13 can be used as the adjustment members. In this case, even when the elongated holes 21*b* and 22*b* are each a pin hole, by virtue of the elastic forces of the adjustment members, the pressing forces of the car doors applied when the car-side door panels 21 and 22 are fully closed cause the pressure sensor 61*a* and the repulsive member 62*a* to automatically rotate, enabling them to be parallel with each other as in Embodiment 2.

Further, in a case of such a configuration, Expression (1) described above is satisfied.

Figure 9:
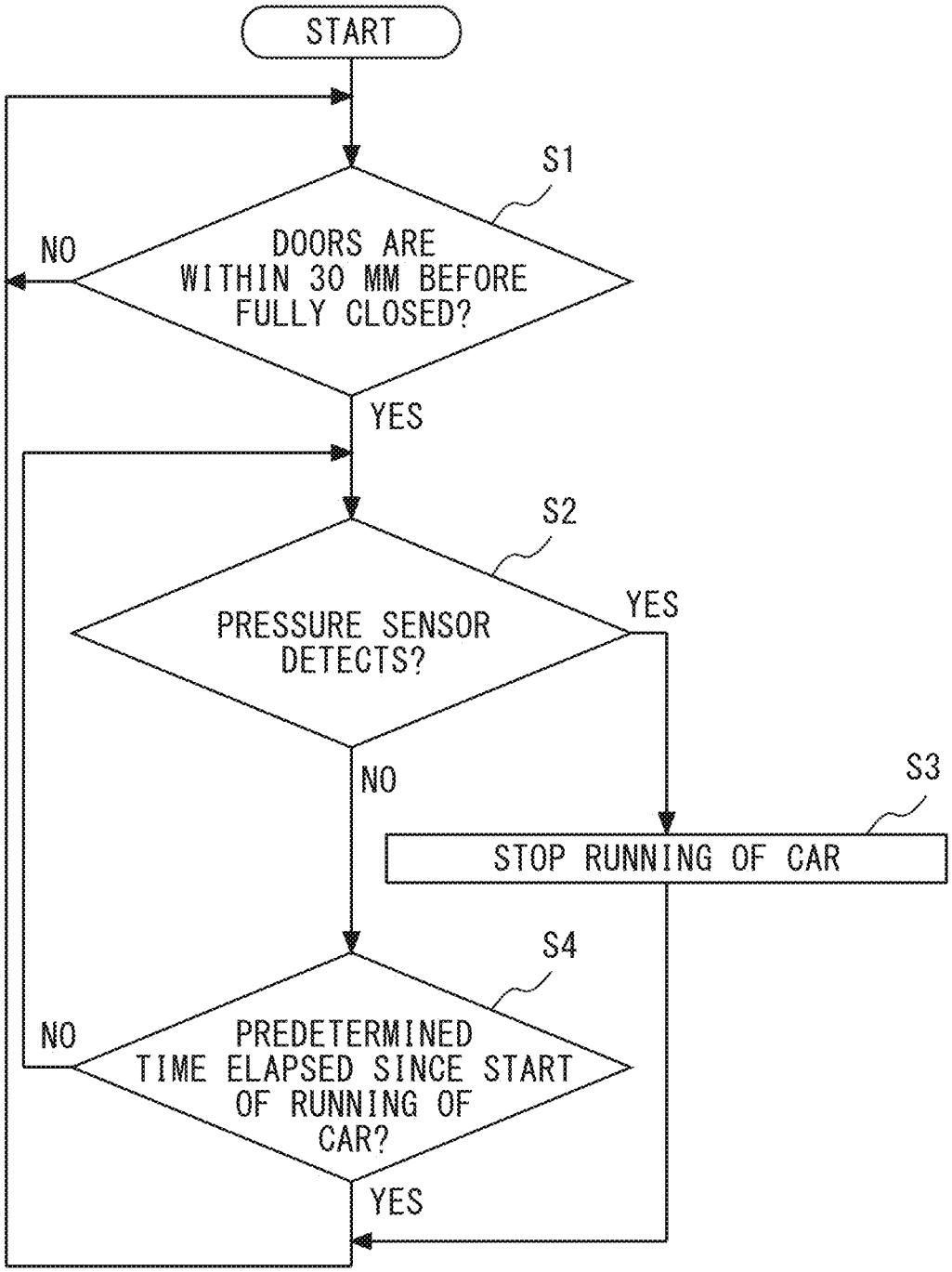
FIG. 9 is a control flowchart of the door device of the present application.

FIG. 9 is a control flowchart for a door device including a door-pinch detection device. This control flowchart is applicable to the configurations of Embodiments 1 to 3.

In step 1 (S1), the door controller 40 judges, during the door close motion, whether or not the doors are within 30 mm from each other before being fully closed. If they are within 30 mm, the process proceeds to step 2.

In step 2 (S2), the door controller 40 judges whether or not the pressure sensor (11*a*, 51*a*, 61*a*) has detected an alien object. If the pressure sensor has detected an alien object, the process proceeds to step 3. If the pressure sensor has detected no alien object, the process proceeds to step 4.

In step 3 (S3), the door controller 40 transmits a running stop signal for the car to a control panel (not shown) in order for the car not to run. When receiving the running stop signal, the control panel performs a control to cause a traction machine (not shown) not to be driven.

In step 4 (S4), the door controller 40 judges whether or not a predetermined time (for example, 3 seconds) has elapsed since the start of the running of the car. If the predetermined time has elapsed, the process proceeds to S1. If the predetermined time has not elapsed, the process returns to S2. It should be noted that the predetermined time may be set at the time of shipment from the factory or may be changed by a maintainer after the elevator is installed.

By providing S4, even after the running of the car is started, detection performed by the pressure sensor is to continue until the predetermined time elapses. The running of the car can be stopped even if the pressure sensor detects an alien object immediately after the running of the car is started, which enabling the safety of the elevator to be improved.

Although Embodiments 1 to 3 described above each relate to a double-doored configuration, a similar effect can be obtained in a case of a single-swinging door by attaching one of a pressure sensor and a repulsive member to a door-hitting-side frame.

REFERENCE SIGNS LIST

100 door device
10 door-pinch detection device
1 string
11 first attachment member
11*a* pressure sensor
11*b* elongated hole
11*c* pin hole
12 second attachment member
12*a* repulsive member
12*b* elongated hole
12*c* pin hole
13 fitting
21 car-side door panel
21*a* door hitting face
21*b* elongated hole
22 car-side door panel
22*a* door hitting face
22*b* elongated hole
40 door controller
52*c* adjustment member

The invention claimed is:

1. A door-pinch detection device, comprising:

a first attachment section and a second attachment section attached to at least either side face of a front face or a back face of a door panel of an elevator, the first attachment section including a pressure sensor, the second attachment section including a repulsive member installed in a manner for the pressure sensor to be housed therein; and at least either one of a first angle adjustment section provided in the first attachment section to adjust an attachment angle of the pressure sensor with respect to the door panel for installation or a second angle adjustment section provided in the second attachment section to adjust an attachment angle of the repulsive member with respect to the door panel for installation, wherein the pressure sensor is configured to detect an alien object.

2. The door-pinch detection device according to claim 1, wherein the first angle adjustment section includes an elongated hole made in the first attachment section, the second angle adjustment section includes an elongated hole made in the second attachment section, and the first attachment section or the second attachment section is fixed to the door panel with the attachment angle adjusted by adjusting a position for a fitting to penetrate the elongated hole, the fitting penetrating the elongated hole and being fixed at a hole made in the front face or the back face of the door panel.

3. The door-pinch detection device according to claim 1, wherein the first angle adjustment section includes an adjustment member with an elastic force provided in the first attachment section, the second angle adjustment section includes an adjustment member with an elastic force provided in the second attachment section, and each of the adjustment members causes the pressure sensor or the repulsive member to swingably move.

4. The door-pinch detection device according to claim 3, wherein the adjustment member is a resin.

5. The door-pinch detection device according to claim 3, wherein the adjustment member is a spring.

6. The door-pinch detection device according to claim 3, wherein a repulsive force of the adjustment member is larger than a motion sensitivity of the pressure sensor and smaller than a pressing force applied to a door hitting face of the door panel when doors of the elevator are closed.

7. The door-pinch detection device according to claim 1, wherein the pressure sensor is installed to project with respect to a door hitting face of the door panel.

8. The door-pinch detection device according to claim 1, wherein the pressure sensor is installed to retract with respect to a door hitting face of the door panel.

9. An elevator door device, comprising:

a door panel of an elevator;

a door-pinch detection device including a first attachment section and a second attachment section installed on at least either one of a front face or a back face of the door panel, the first attachment section including a pressure sensor, the second attachment section including a repulsive member installed in a manner for the pressure sensor to be housed therein when doors of the elevator are closed; and an angle adjustment section provided in the door panel to adjust an attachment angle of at least either one of the first attachment section or the second attachment section for installation, where the pressure sensor is configured to detect an alien object.

10. The elevator door device according to claim 9, wherein the third angle adjustment section includes an elongated hole made in at least either one of the front face or the back face of the door panel, and at least either one of the first attachment section or the second attachment section has a hole penetrating therethrough and is fixed to the elongated hole at an angle relative to a door hitting face of the door panel with a fitting penetrating the hole.

11. The elevator door device according to claim 10, wherein the third angle adjustment section includes an adjustment member with an elastic force, and the adjustment member causes the pressure sensor or the repulsive member to swingably move.

12. The elevator door device according to claim 11, wherein the adjustment member is a resin.

13. The elevator door device according to claim 11, wherein the adjustment member is a spring.

14. The elevator door device according to claim 11, wherein a repulsive force of the adjustment member is larger than a motion sensitivity of the pressure sensor and smaller than a pressing force applied to a door hitting face of the door panel when the doors are closed.

15. The elevator door device according to claim 9, wherein the pressure sensor is installed to project with respect to a door hitting face of the door panel.

16. The elevator door device according to claim 9, wherein the pressure sensor is installed to retract with respect to a door hitting face of the door panel.

* * * * *